US011054758B2

(12) United States Patent
Matsumoto et al.

(10) Patent No.: US 11,054,758 B2
(45) Date of Patent: Jul. 6, 2021

(54) TRANSFER UNIT AND IMAGE-FORMING APPARATUS TO INCREASE A RATIO OF FILLED TONER VOLUME TO TONER CONTAINER VOLUME

(71) Applicant: CANON KABUSHIKI KAISHA, Tokyo (JP)

(72) Inventors: Norihiro Matsumoto, Yokohama (JP); Takehiro Hayashi, Kawasaki (JP); Akinori Mitsumata, Tokyo (JP); Takeo Kawanami, Kamakura (JP); Yuichiro Inaba, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/884,742

(22) Filed: May 27, 2020

(65) Prior Publication Data

US 2020/0379368 A1 Dec. 3, 2020

(30) Foreign Application Priority Data

May 31, 2019 (JP) ..... JP2019-102858
Apr. 22, 2020 (JP) ..... JP2020-076005

(51) Int. Cl.
*G03G 15/16* (2006.01)
*G03G 15/01* (2006.01)
*G03G 15/08* (2006.01)

(52) U.S. Cl.
CPC ..... *G03G 15/0189* (2013.01); *G03G 15/0865* (2013.01)

(58) Field of Classification Search
CPC .. G03G 15/161; G03G 15/166; G03G 15/168; G03G 21/10; G03G 21/105; G03G 21/12
USPC ..... 399/101, 358, 360
See application file for complete search history.

(56) References Cited

U.S. PATENT DOCUMENTS 6,035,158 A * 3/2000 Asakura et al. ..... G03G 15/161 399/101
7,103,308 B2 * 9/2006 Wakana ..... G03G 21/12 399/358
7,221,887 B2 * 5/2007 Kimura et al. ..... G03G 15/168 399/101

FOREIGN PATENT DOCUMENTS

JP 2007-286371 A 11/2007
JP 2013-130752 A 7/2013
JP 2015-129889 A 7/2015

* cited by examiner

*Primary Examiner* — William J Royer
(74) *Attorney, Agent, or Firm* — Canon U.S.A., Inc. I.P. Division

(57) ABSTRACT

A container to store residual transfer toner remaining on an intermediate transfer belt is disposed in a region of a transfer unit, where the region is defined by an inner circumferential surface of the intermediate transfer belt. A single conveyance member, which rotates to convey toner conveyed from an inlet toward the container, is disposed in the inside of the container. An end portion of the conveyance member that is opposite to an end portion on a side of the inlet is located in a central region of the container.

20 Claims, 14 Drawing Sheets

TRANSFER UNIT AND IMAGE-FORMING APPARATUS TO INCREASE A RATIO OF FILLED TONER VOLUME TO TONER CONTAINER VOLUME

BACKGROUND OF THE DISCLOSURE

Field of the Disclosure

The present disclosure relates to a transfer unit and an electrophotographic image-forming apparatus such as a copying machine or a printer.

Description of the Related Art

A tandem image-forming apparatus known as an electrophotographic image-forming apparatus includes image-forming units that are arranged in a movement direction of a belt such as a conveyance belt or an intermediate transfer belt. Each of the image-forming units for respective colors includes a drum-shaped photosensitive member (referred to below as a photosensitive drum) that serves as an image-hearing member. A toner image of each color that is borne by the photosensitive drum for the color is transferred to a transfer material such as paper or an OHP sheet that is conveyed by a transfer-material-conveying belt, or fixed to the transfer material by a fixing unit after being transferred to the intermediate transfer belt once and subsequently transferred to the transfer material.

In some cases, a part of toner is not transferred and remains on the belt, such as a conveyance belt or an intermediate transfer belt, after the other part is transferred to the transfer material. Such residual toner is collected in a container that stores the residual toner by using a collection unit that is disposed in the image-forming apparatus. This inhibits a defective image from being produced by transferring the residual toner to a transfer material in a next image formation process.

Japanese Patent Application Laid-Open No. 2007-286371 discloses that a first conveyance member that conveys toner in a first direction and second and third conveyance members that convey the toner in a second direction perpendicular to the first direction are disposed in a container that stores collected residual toner. With this structure, the first conveyance member first conveys the residual toner in the first direction along a side of the container. Subsequently, the second and third conveyance members that are arranged at different positions in the first direction convey the residual toner in the second direction. This enables the toner to be efficiently filled in the container.

With the structure in Japanese Patent Application Laid-Open No. 2007-286371, the residual toner can be efficiently filled with respect to the volume of the container. However, since the conveyance members are disposed in the container, the volume of the toner that can be filled in the container decreases by the volume of a region that the conveyance members occupy. In recent years, there has been a need to decrease the size of an image-forming apparatus, and there has been a need to increase the ratio of the volume of filled toner to the volume of a container.

SUMMARY OF THE DISCLOSURE

According to the present disclosure, in a container to store residual toner, a conveyance member that conveys the toner is disposed, and the ratio of the volume of the filled toner to the volume of the container is increased.

According to an aspect of the present disclosure, a transfer unit disposed in an image-forming apparatus, wherein the image-forming apparatus includes an image-bearing member configured to bear a toner image, includes a belt that is movable, endless, and in contact with the image-bearing member, a collection member which is in contact with the belt and configured to collect toner remaining on the belt, a container, which is disposed in a region defined by an inner circumferential surface of the belt, which has an inlet through which the toner collected by the collection member enters the container, and which has a bottom surface on which the toner entering through the inlet is to be supported and an upper surface that is opposite to the bottom surface, and a single conveyance member which includes a conveyance portion spirally extending in a rotation axis direction and which is configured to rotate to convey the toner from the inlet in the container, wherein, in a projected view of the container on a horizontal plane in a direction orthogonal to a movement direction and a width direction, a central region of the container is located in a region in which a middle region of trisected regions of the container in the movement direction overlaps a middle region of trisected regions of the container in the width direction, and wherein the single conveyance member conveys the toner from the inlet toward the central region of the container.

Further features and aspects of the present disclosure will become apparent from the following description of example embodiments with reference to the attached drawings.

DESCRIPTION OF THE EMBODIMENTS

The embodiments will hereinafter be described in detail by way of example with reference to the drawings. The dimensions, materials, shapes, and relative positions of components described according to the embodiments may be appropriately changed depending on the structure of an apparatus for which the present disclosure is used or various conditions. Accordingly, the scope of the present disclosure is not limited to these unless there is a specific description.

First Example Embodiment

Structure of Example Image-Forming Apparatus

Figure 1:
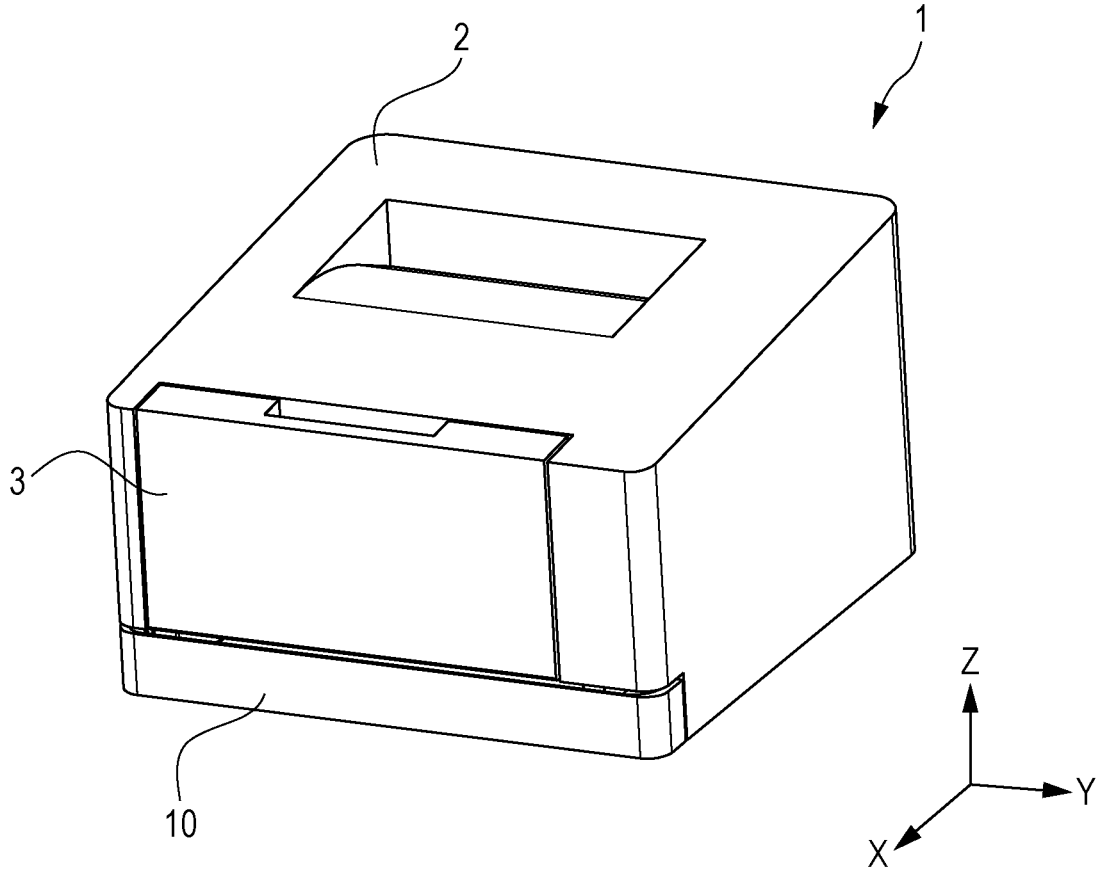
FIG. 1 is a schematic perspective view of the structure of an image-forming apparatus according to a first example embodiment.
Figure 2:
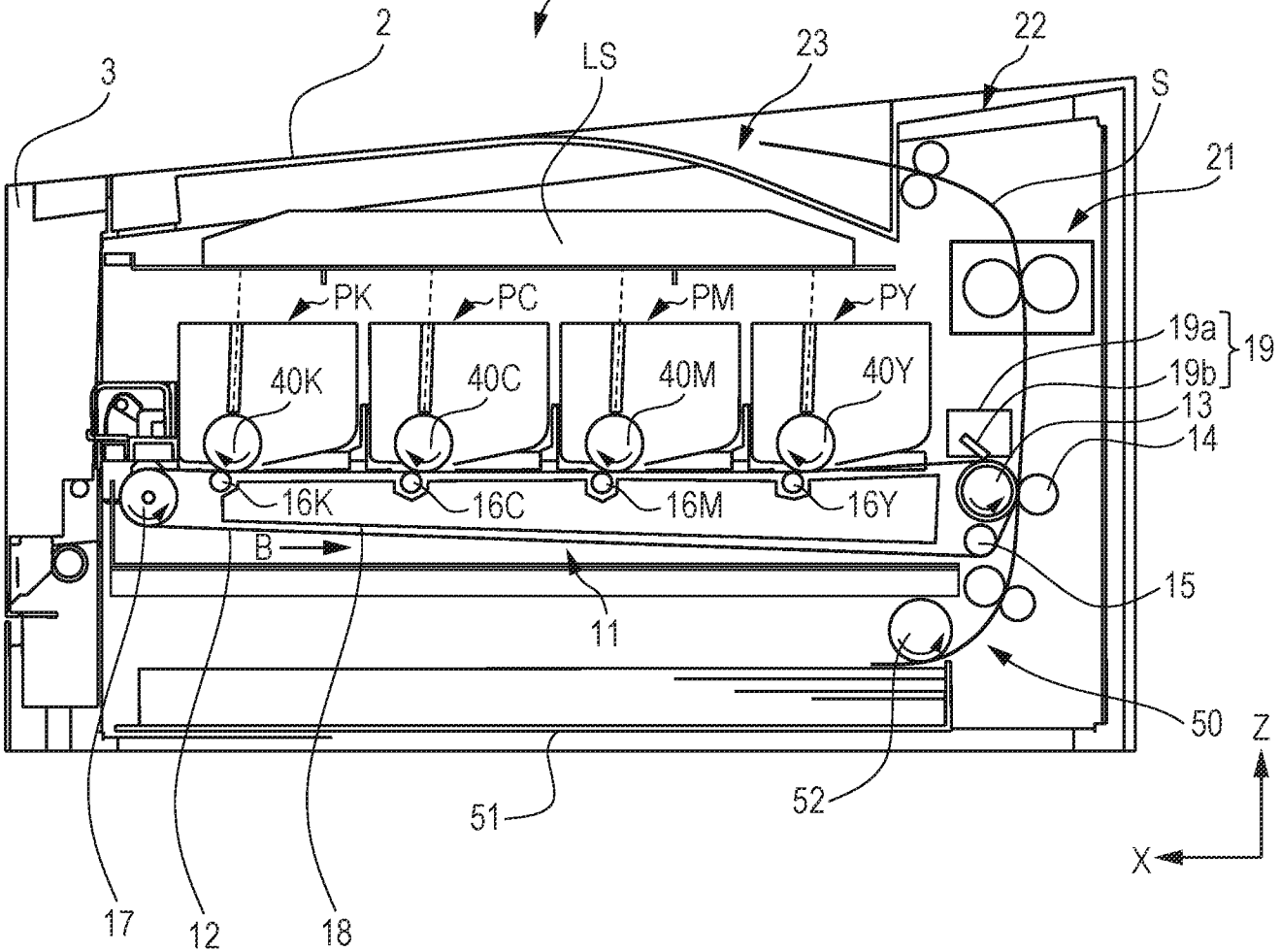
FIG. 2 is a schematic sectional view of an internal structure of the image-forming apparatus according to the first example embodiment.

FIG. 1 is a schematic perspective view of the structure of an image-forming apparatus 1 according to the present embodiment. FIG. 2 is a schematic sectional view of an internal structure of the image-forming apparatus 1. The image-forming apparatus 1 according to the present embodiment is a so-called tandem image-forming apparatus that includes image-forming units PY, PM, PC, and PK. The first image-forming unit PY uses yellow (Y) toner, the second image-forming unit PM uses magenta (M) toner, the third image-forming unit PC uses cyan C toner, and the fourth image-forming unit PK uses black (Bk) toner to form an image.

The image-forming apparatus 1 operates in a process cartridge method. The image-forming units PY, PM, PC, and PK are provided as process cartridges and can be attached to and detached from an apparatus body 2. The process cartridges are detached or attached with a door 3 of the image-forming apparatus 1 opened. Below door 3 is a sheet feed cassette 10. As illustrated in FIG. 2, the four image-forming units PY, PM, PC, and PK are lined up at regular intervals. Many parts of the structure of each image-forming unit PY, PM, PC, and PK are substantially common to each other except for the color of the toner that is stored therein. Accordingly, provided that it is not necessary to distinguish these components, the final reference characters Y, M, C, and K that represent the colors for which the components are used are omitted in the following description, and the components will be collectively described.

In the following description, a surface of the image-forming apparatus 1 along which the door 3 is disposed is referred to as a front surface, and a surface opposite the front surface is referred to as a back surface. When the image-forming apparatus 1 is viewed in front of the front surface, the right-hand side is referred to as a drive side, and the left-hand side is referred to as a non-drive side. In the drawings, a direction from the back surface of the apparatus body 2 toward the front surface thereof is referred to as an X-axis direction, a direction from the non-drive side of the apparatus body 2 toward the drive side thereof is referred to as a Y-axis direction, and a direction from the bottom surface of the apparatus body 2 toward the upper surface thereof is referred to as a Z-axis direction.

As illustrated in FIG. 2, the image-forming units P are arranged parallel to the bottom surface of the apparatus body 2. Each image-forming unit P includes an electrophotographic process mechanism. A rotation driving force is transmitted from a cartridge driving force transmitter, not illustrated, which is disposed in the apparatus body 2. The image-forming units P include respective photosensitive drums 40 that serve as image-bearing members that bear toner images, respective charge units (not illustrated), and respective development units (not illustrated).

An exposure unit LS is disposed above the image-forming units P in the Z-axis direction. The exposure unit LS emits a laser beam based on image information that a controller, not illustrated, receives. The laser beam that is emitted from the exposure unit LS passes through an exposure window of each image-forming unit P and reaches the surface of each photosensitive drum 40 for scan exposure.

A transfer unit 11 is disposed below the image-forming units P in the Z-axis direction. The transfer unit 11 includes a movable, endless, intermediate transfer belt 12, primary transfer rollers 16, a drive roller 13, a stretch roller 17, a stretch roller 15, a collection unit 19, and a container 18. The drive roller 13 rotates when a driving force is applied thereto, moves the intermediate transfer belt 12 in the direction of an arrow B in FIG. 2, and stretches the intermediate transfer belt 12 together with the stretch roller 17 and the stretch roller 15. The collection unit 19 collects toner that remains on the intermediate transfer belt 12. The toner that is collected by the collection unit 19 is stored in the container 18 that is disposed in a region that is defined by the inner circumferential surface of the intermediate transfer belt 12.

The primary transfer rollers 16 serve as transfer units that transfer the toner images that are borne by the photosensitive drums 40 from the photosensitive drums 40 to the intermediate transfer belt 12 and are in contact with the inner circumferential surface of the intermediate transfer belt 12. The primary transfer rollers 16Y, 16M, 16C, and 16K respectively face the photosensitive drums 40Y, 40M, 40C, and 40K with the intermediate transfer belt 12 interposed therebetween. The primary transfer rollers 16 extend in a direction perpendicular to the direction of the arrow B in FIG. 2, that is, in the Y-axis direction, urge the intermediate transfer belt 12 against the photosensitive drums 40, and define primary transfer portions at which the photosensitive drums 40 and the intermediate transfer belt 12 are in contact with each other.

According to the present embodiment, each primary transfer roller 16 is a metal roller that has no elastic layer. The primary transfer roller 16, which is a metal roller, is low in cost but carries a risk that the primary transfer roller 16 causes a facing component to wear because of the hardness thereof. In view of this, according to the present embodiment, as illustrated in FIG. 2, the primary transfer rollers 16 are shifted from the positions of the primary transfer portions at which the photosensitive drums 40 and the intermediate transfer belt 12 are in contact with each other. More specifically, the primary transfer rollers 16 are shifted to positions downstream of the primary transfer portions in the movement direction of the intermediate transfer belt 12. The primary transfer rollers 16 may be shifted to positions upstream of the primary transfer portions.

The collection unit 19 includes a frame body 19*a* and a cleaning blade 19*b* (collection member) that is disposed in the frame body 19*a* and that extends in the Y-axis direction. The cleaning blade 19*b* extends in the direction opposite the movement direction of the intermediate transfer belt 12 and is in contact with the outer circumferential surface of the intermediate transfer belt 12 to collect the toner that remains on the intermediate transfer belt 12 in the frame body 19*a*.

A secondary transfer roller 14 faces the drive roller 13 (driving rotary member) with the intermediate transfer belt 12 interposed therebetween. A secondary transfer portion is defined at a position at which the secondary transfer roller 14 and the intermediate transfer belt 12 are in contact with each other. A feed unit 50 includes a sheet feed cassette 51 (sheet feed cassette 10 in FIG. 1) that stores a transfer material S and a sheet-feeding roller 52 that feeds the transfer material S from the sheet feed cassette 51 toward the secondary transfer portion, and is disposed upstream of the secondary transfer portion in a direction in which the transfer material S is conveyed.

A fixing unit 21 that fixes a toner image to the transfer material S and a pair of discharge rollers 22 that discharges the transfer material S to which the toner image is fixed from the apparatus body 2 are disposed downstream of the secondary transfer portion in the movement direction of the transfer material S. The transfer material S that is discharged from the apparatus body 2 by using the pair of discharge rollers 22 is loaded on a discharge tray 23.

Example Image Formation Operation

The image formation operation of the image-forming apparatus 1 according to the embodiment of the present disclosure will now be described. When a control unit (not illustrated) such as the controller receives an image signal, the image formation operation starts, and the photosensitive drums 40 and the drive roller 13, for example, start rotating at a predetermined circumferential speed (process speed) due to a driving force from a drive source, not illustrated.

The surfaces of the photosensitive drums 40 are uniformly charged by the charge units, not illustrated, to have the same polarity as the regular charge polarity (negative polarity according to the present embodiment) of the toner. Subsequently, a laser beam is emitted from the exposure unit LS to form electrostatic latent images based on the image information. The electrostatic latent images that are formed on the photosensitive drums 40 are developed by using the toner that the development units, not illustrated, store. Toner images based on the image information are borne on the surfaces of the photosensitive drums 40. At this time, the toner images depending on image components of yellow, magenta, cyan, and black colors are borne by the photosensitive drums 40Y, 40M, 40C, and 40K.

Subsequently, the color toner images that are borne by the photosensitive drums 40 reach the respective primary transfer portions with rotation of the photosensitive drums 40. A voltage is applied from a power supply, not illustrated, to the primary transfer rollers 16, and the color toner images that are borne by the photosensitive drums 40 are primarily transferred to the intermediate transfer belt 12 in order at the primary transfer portions. Consequently, four toner images corresponding to the target color images are formed on the intermediate transfer belt 12.

Subsequently, the four toner images that are borne by the intermediate transfer belt 12 reach the secondary transfer portion with rotation of the intermediate transfer belt 12 and are secondarily transferred collectively to a surface of the transfer material S such as paper or an OHP sheet when passing through the secondary transfer portion. At this time, a voltage of the polarity opposite the regular charge polarity of the toner is applied from a secondary transfer power supply, not illustrated, to the secondary transfer roller 14.

The transfer material S that is stored in the sheet feed cassette 51 is fed from the sheet feed cassette 51 by using the sheet-feeding roller 52 with a predetermined timing and conveyed toward the secondary transfer portion. The transfer material S to which the four toner images are transferred at the secondary transfer portion is heated and pressed by the fixing unit 21 and consequently fixed to the transfer material S with the toner of the four colors melted and mixed. Subsequently, the transfer material S is discharged from the apparatus body 2 by using the pair of discharge rollers 22 and loaded on the discharge tray 23 that serves as a loader.

After the secondary transfer, the toner (referred to below as residual transfer toner) that remains on the intermediate transfer belt 12 is removed from the surface of the intermediate transfer belt 12 by using the collection unit 19 that faces the drive roller 13 with the intermediate transfer belt 12 interposed therebetween. The image-forming apparatus 1 according to the present embodiment forms a full-color printed image by the above operation.

The image-forming apparatus 1 according to the present embodiment includes the controller, not illustrated, which controls the operation of each component of the image-forming apparatus 1, and a memory (not illustrated) that serves as a storage unit that stores various kinds of control information. The controller controls conveyance of the transfer material S, controls drive of the intermediate transfer belt 12 and the image-forming units P as the process cartridges, controls image formation, and controls malfunction detection.

Example Collection of Residual Transfer Toner with Collection Unit

After the secondary transfer, the residual transfer toner on the intermediate transfer belt 12 is physically scraped from the intermediate transfer belt 12 by using the cleaning blade 19*b* and temporally stored in the frame body 19*a* of the collection unit 19. A process of collecting the residual transfer toner by using the collection unit 19 will now be described.

Figure 3A:
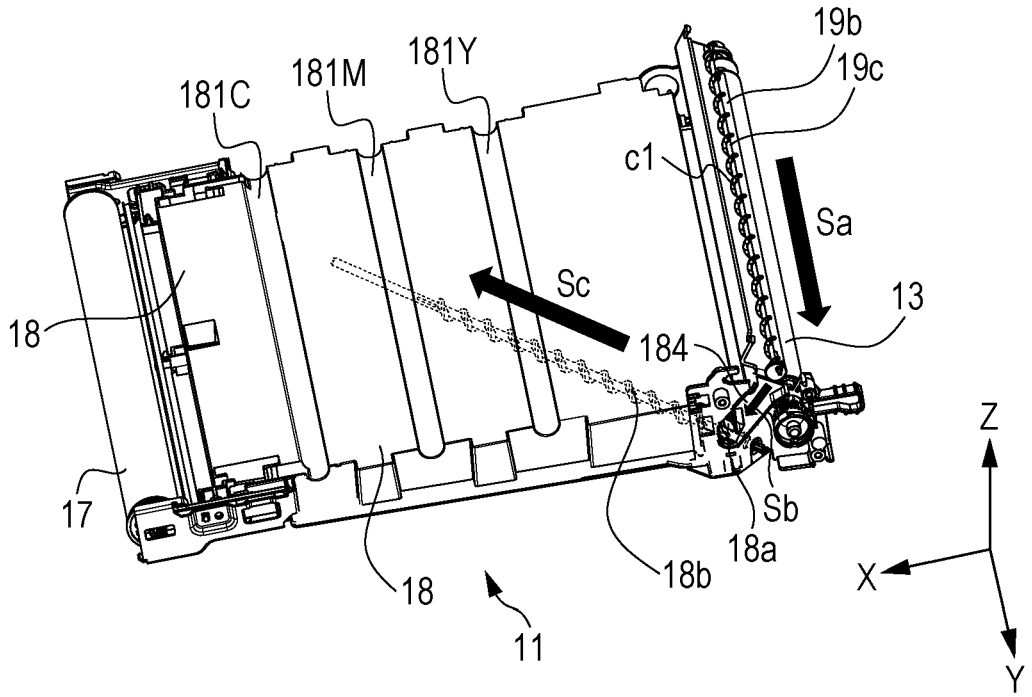
FIG. 3A and FIG. 3B illustrate schematic perspective views of the structure of a transfer unit according to the first example embodiment.
Figure 3B:
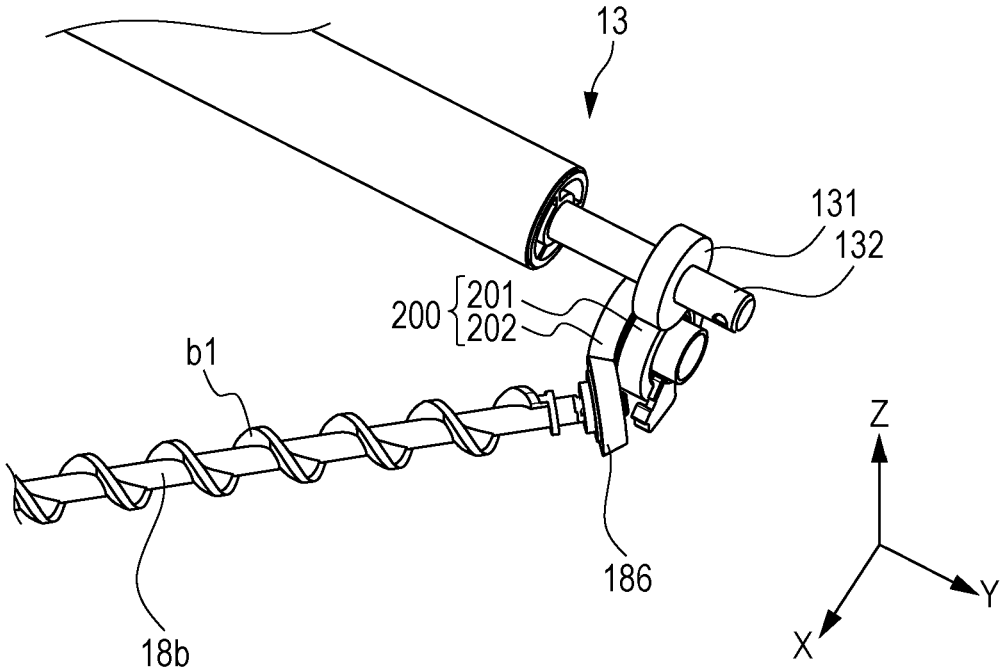

FIG. 3A is a schematic perspective view of the structure of the transfer unit 11 with the intermediate transfer belt 12 removed. Arrows in FIG. 3A represent a conveyance route for the residual transfer toner that is collected by the cleaning blade 19*h*. In FIG. 3A and FIG. 3B, an illustration of the frame body 19*a* is omitted to illustrate an internal structure of the collection unit 19. In the frame body 19*a*, the collection unit 19 includes the cleaning blade 19*b* and a conveyance member 19*c* that conveys the residual transfer toner scraped from the intermediate transfer belt 12 by using the cleaning blade 19*b*. The conveyance member 19*c* includes a conveyance portion cl spirally extending in a rotation axis direction thereof and rotates when a driving force from a drive source, not illustrated, is applied thereto to convey the residual transfer toner in the direction of an arrow Sa (Y-axis direction) in FIG. 3A.

Subsequently, the residual transfer toner that is conveyed in the direction of the arrow Sa in FIG. 3A in the frame body 19*a* is conveyed in the direction of an arrow Sb in FIG. 3A along a conveyance path 184 near a downstream end portion in the direction in which the toner is conveyed by the conveyance member 19*c*, in other words, adjacent to an end portion near the drive side of the transfer unit 11. The conveyance path 184 is connected to an inlet 18*a* of the container 18. A conveyance member 18*b* an end of which is located near the inlet 18*a* is disposed in the container 18. The conveyance member 18*b* includes a conveyance portion b1 spirally extending in the rotation axis direction and rotates to convey the residual transfer toner that reaches the inlet 18*a* in the direction of an arrow Sc in FIG. 3A.

FIG. 3B schematically illustrates a mechanism for transmitting a drive force to the conveyance member 18*b* and the drive roller 13 disposed at the end portion near the drive side of the transfer unit 11. According to the present embodiment, as illustrated in FIG. 3B, the drive of the conveyance member 18*b* and the drive of the drive roller 13 are connected to each other by using a drive connection member 200 that includes a gear 201 and a gear 202. More specifically, the drive roller 13 includes a gear 131 at the end portion near the drive side. The conveyance member 18*b* includes a gear 186 at the end portion near the drive side. The gear 131 engages the gear 201. The gear 186 engages the gear 202. The drive roller 13 includes a shaft 132. When a driving force from a drive source, not illustrated, is applied to the shaft 132, and the shaft 132 rotates, the gear 131 rotates. The rotational force of the drive roller 13 is transmitted to the gear 186 via the drive connection member 200 as a result of the rotation of the gear 131, and the conveyance member 18*b* rotates.

Example Structure of Transfer Unit and Container

Figure 4A:
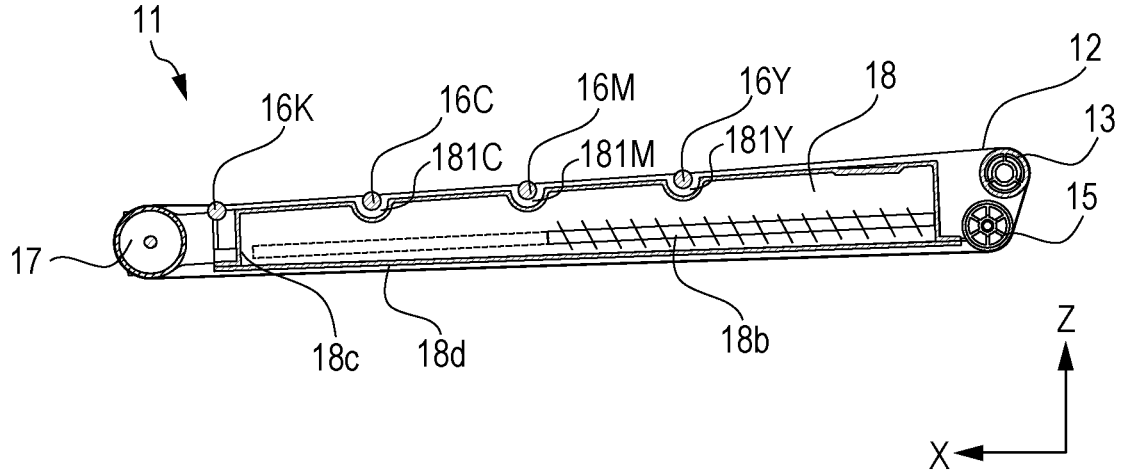
FIG. 4A and FIG. 4B illustrate schematic side views of the structure of the transfer unit according to the first example embodiment.
Figure 4B:
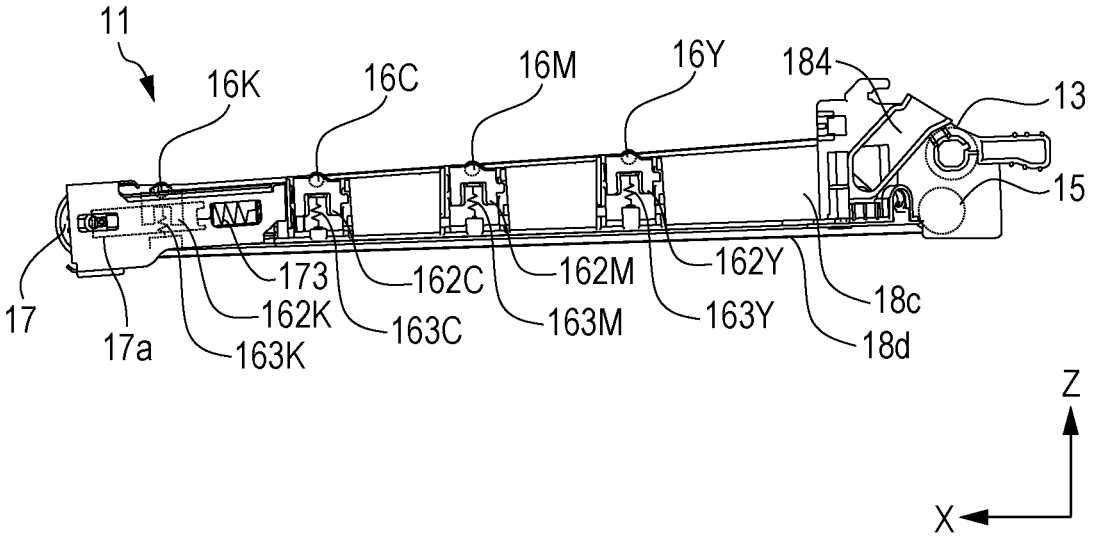

FIG. 4A is a schematic sectional view of the transfer unit 11 viewed from a side surface (XZ plane). FIG. 4B is a schematic side (XZ plane) view of the structure of the transfer unit 11 viewed in front of the drive side. In FIG. 4B, an illustration of the intermediate transfer belt 12 is omitted. As illustrated in FIG. 4A and FIG. 4B, the container 18 according to the present embodiment is disposed in a region of the transfer unit 11 that is defined by the inner circumferential surface of the intermediate transfer belt 12. The bottom surface of the transfer unit 11 and the bottom surface of the container 18 are substantially parallel to the bottom surface of the image-forming apparatus 1.

According to the present embodiment, the container 18 includes an upper member 18*c* that forms the upper surface of the container 18 and a lower member 18*d* that forms the bottom surface of the container 18 in the gravity direction. The upper member 18*c* and the lower member 18*d* constitute a container frame body. More specifically, the upper member 18*c* is disposed near the primary transfer rollers 16, and the lower member 18*d* is disposed in the transfer unit 11 near the bottom surface of the image-forming apparatus 1. The upper member 18*c* that has a substantially rectangular shape on the XY plane and four end portions of the lower member 18*d* are joined to each other by ultrasonic welding, and the upper member 18*c* and the lower member 18*d* consequently constitute the frame body of the container 18. The upper member 18*c* and the lower member 18*d* may not be secured to each other by ultrasonic welding but may be secured to each other by another welding method such as thermal welding, fastening, or a joining method with an adhesive, provided that the residual transfer toner does not leak from the container 18.

As illustrated in FIG. 4A, portions of the upper member 18*c* that face the primary transfer rollers 16Y, 16M, and 16C are recessed in the direction away from the positions of the primary transfer rollers 16, that is, in the direction toward the lower member 18*d*. More specifically, the upper member 18*c* has grooved portions 181Y, 181M, and 181C that are formed at positions below the primary transfer rollers 16 and that extend in the extension direction of the primary transfer rollers 16. With this structure, the container 18 does not restrict rotation of the primary transfer rollers 16, and a sufficient toner storage capacity of the container 18 can be ensured. The grooved portions 181Y, 181M, and 181C of the upper member 18*c* increase the strength of the container 18 and inhibit the container frame body from deforming.

As illustrated in FIG. 4B, end portions of the primary transfer rollers 16Y, 16M, 16C, and 16K in the extension direction of the primary transfer rollers 16 are rotatably supported by respective primary transfer bearings 162Y, 162M, 162C, and 162K. The primary transfer bearings 162Y, 162M, 162C, and 162K are urged in the +Z direction by using springs 163Y, 163M, 163C, and 163K each of which is secured at an end thereof to the upper member 18*c* and are supported by the upper member 18*c* so as to be movable in the Z-axis direction.

According to the present embodiment, the primary transfer rollers 16 include no mechanisms for separation from the intermediate transfer belt 12. That is, the primary transfer rollers 16 are urged by the springs 163 (urging members), and the intermediate transfer belt 12 and the photosensitive drums 40 are always in contact with each other. Since the transfer unit 11 includes no mechanisms for separating the primary transfer rollers 16 from the intermediate transfer belt 12, the region in the transfer unit 11 that is used for the capacity of the container 18 can be enlarged as much as possible.

The stretch roller 17 is urged in the +X direction by a tension spring 173 with a bearing 17*a* interposed therebetween to stretch the intermediate transfer belt 12. An end of the tension spring 173 urges the bearing 17*a*, and the other end is supported by the upper member 18*c*. According to the present embodiment, the intermediate transfer belt 12 that is stretched by the stretch roller 17 can be released by moving the bearing 17*a* against the urging force of the tension spring 173.

Example Filling of Residual Transfer Toner in Container

Figure 5:
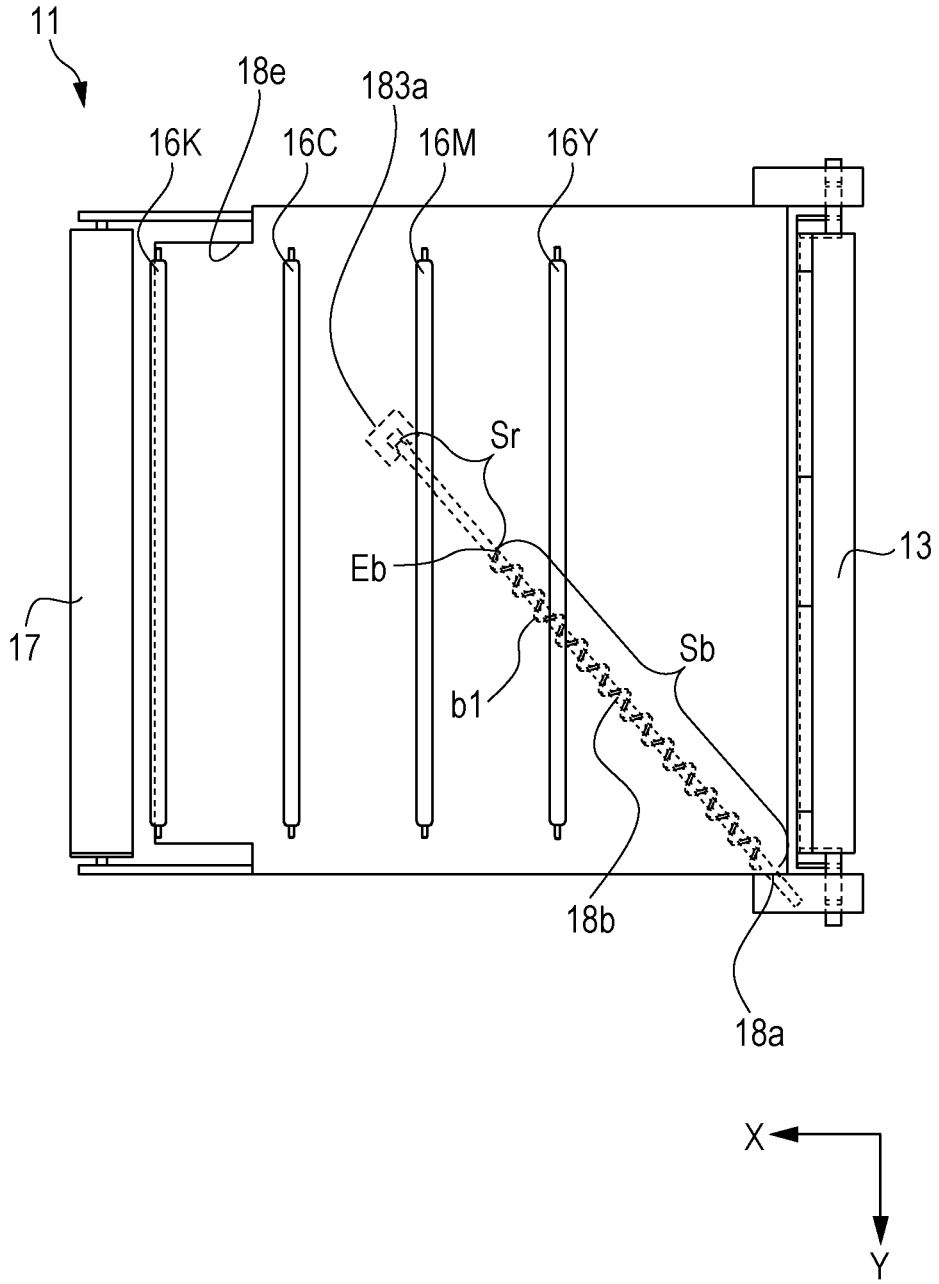
FIG. 5 schematically illustrates the transfer unit and a container according to the first example embodiment.

FIG. 5 schematically illustrates the transfer unit 11 and the container 18 in a projected view on the horizontal plane (XY plane) in the direction perpendicular to the movement direction of the intermediate transfer belt 12 and the extension direction of the primary transfer rollers 16. In FIG. 5, an illustration of the intermediate transfer belt 12 of the transfer unit 11 is omitted to illustrate the structure of the container 18. The residual transfer toner that passes through the conveyance path 184 and that enters the container 18 via the inlet 18*a* is conveyed to a substantially central portion of the container 18 on the XY plane by using the conveyance member 18*b*.

As illustrated in FIG. 5, a first end portion of the conveyance member 18*b* in the rotation axis direction of the conveyance member 18*b* is located near the inlet 18*a*, and a second end portion thereof is supported by a bearing 183*a* (support portion). The bearing 183*a* is included in the lower member 18*d* of the container 18 and rotatably supports the conveyance member 18*b*. The conveyance member 18*b* has a region Sb in which the conveyance portion b1 is disposed and a region Sr in which the conveyance portion b1 is not disposed and there is only a shaft, with respect to the rotation axis direction. An end portion Eb (end) of the conveyance portion b1 opposite the inlet 18*a* in the rotation axis direction is located at the boundary between the region Sb and the region Sr. As illustrated in FIG. 5, the rotation axis direction of the conveyance member 18*b* is not perpendicular to the X-axis direction that coincides with the movement direction of the intermediate transfer belt 12 or the Y-axis direction that coincides with the extension direction of the primary transfer rollers 16 but intersects the X-axis direction and the Y-axis direction.

In a projected view of the container 18 on the XY plane, the end portion Eb is located downstream of the primary transfer roller 16Y and upstream of the primary transfer roller 16K in the X-axis direction that coincides with the movement direction of the intermediate transfer belt 12. In other words, the end portion Eb is located between the primary transfer roller 16Y and the primary transfer roller 16K in the X-axis direction, more specifically, in a central region Rc of the container 18 between the primary transfer roller 16Y and the primary transfer roller 16M according to the present embodiment. The central region Rc will be described in detail later. With this structure according to the present embodiment, the residual transfer toner that enters via the inlet 18*a* is conveyed from the inlet 18*a* toward the end portion Eb in the container 18 by using the conveyance portion b1 and accumulated on the substantially central portion of the container 18 at an end of the region Sb.

If the hearing 183*a* is disposed near the end portion Eb in the rotation axis direction of the conveyance member 18*b* to support the second end portion of the conveyance member 18*b*, then a rotational slide occurs between the bearing 183*a* and the conveyance member 18*b* near a region to which a strong toner conveyance force of the conveyance member 18*b* is applied. With this structure, that is, in the case where there is no region Sr, there is a possibility that the toner is fixed at a position at which the rotational slide occurs, and that conveyance of the residual transfer toner by using the conveyance member 18*b* is consequently less stable.

According to the present embodiment, the residual transfer toner that is conveyed by the conveyance member 18*b* is filled in the container 18 while concentrically diffusing about the end portion Eb although this will be described in detail later. However, if the bearing 183*a* is disposed near the end portion Eb, there is a possibility that the residual transfer toner does not concentrically diffuse. Accordingly, as illustrated in FIG. 5, the region Sr in which there is no spiral conveyance portion b1 is preferably located between the region Sb and the bearing 183*a*. The length of the region Sr in the rotation axis direction is freely set. As illustrated in FIG. 5, the end of the conveyance member 18*b* may not be located near the primary transfer roller 16M on the XY plane of the container 18. For example, the length of the region Sr may be longer than that in FIG. 5, and the end of the conveyance member 18*b* may be located near a wall surface 18*e* on which an imaginary line extending in the rotation axis direction of the conveyance member 18*b* intersects the container 18 on the XY plane.

Figure 6A:
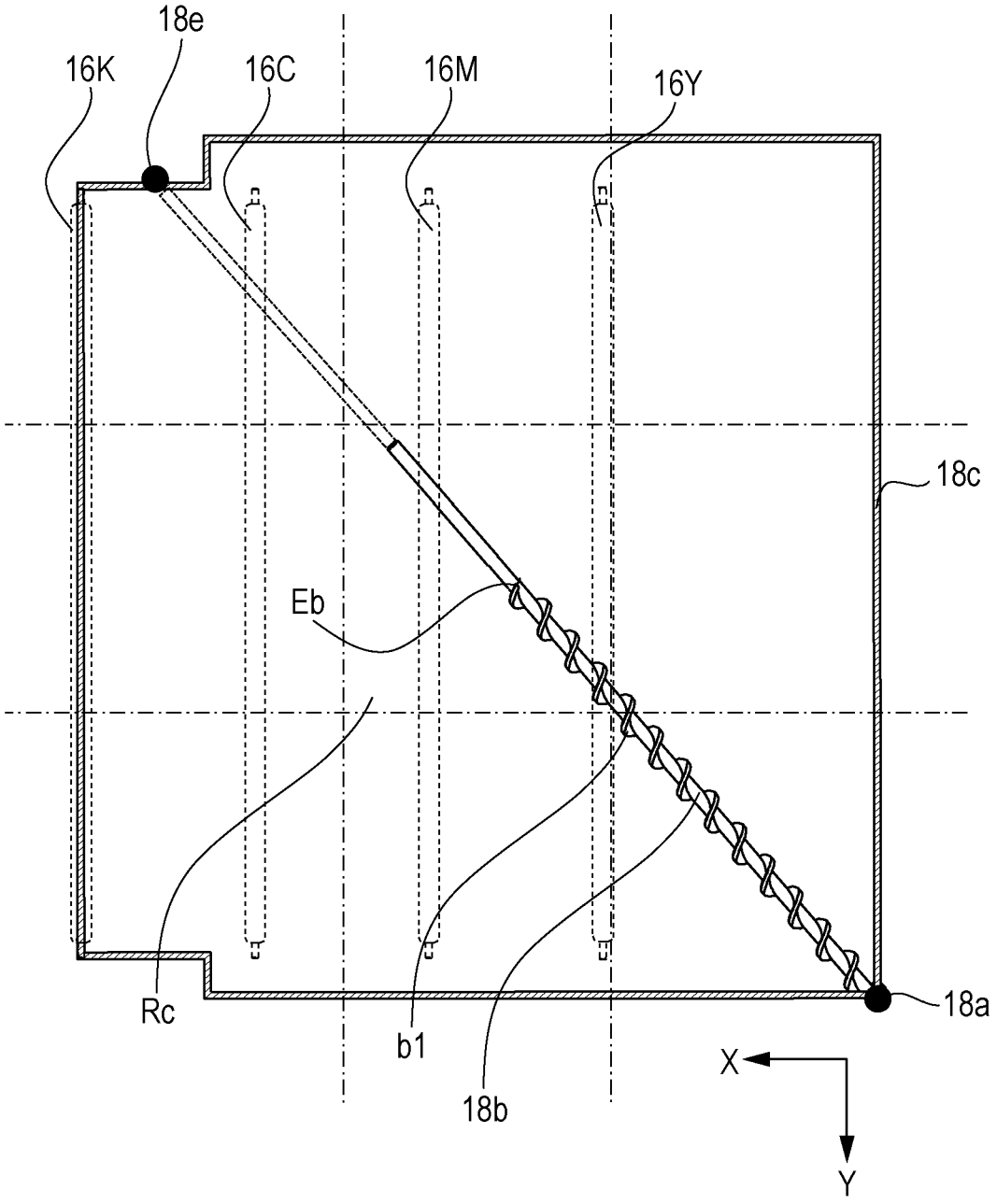
FIG. 6A, FIG. 6B, FIG. 6C and FIG. 6D schematically illustrate filling of residual transfer toner in the container according to the first example embodiment.
Figure 6B:
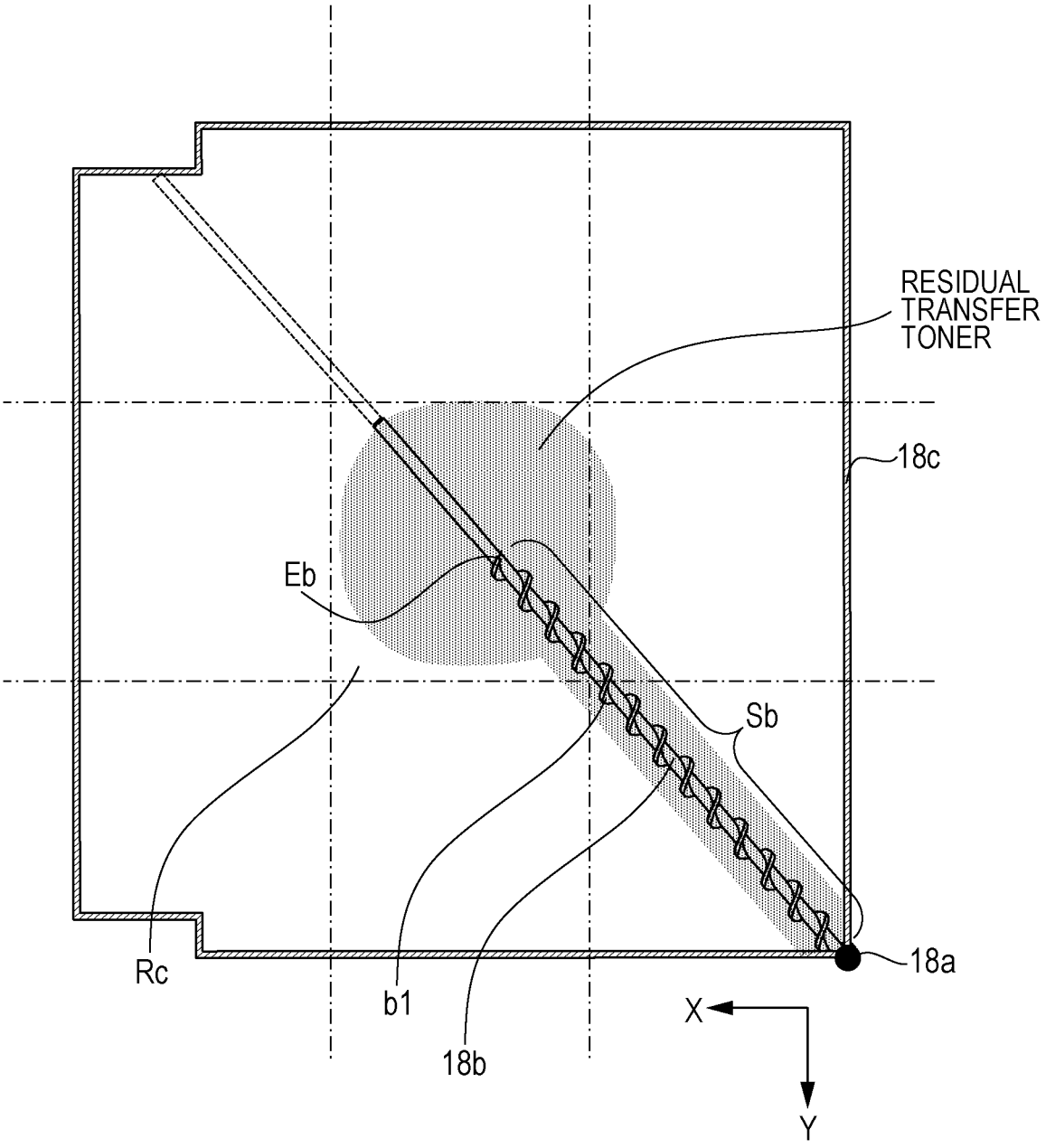
Figure 6C:
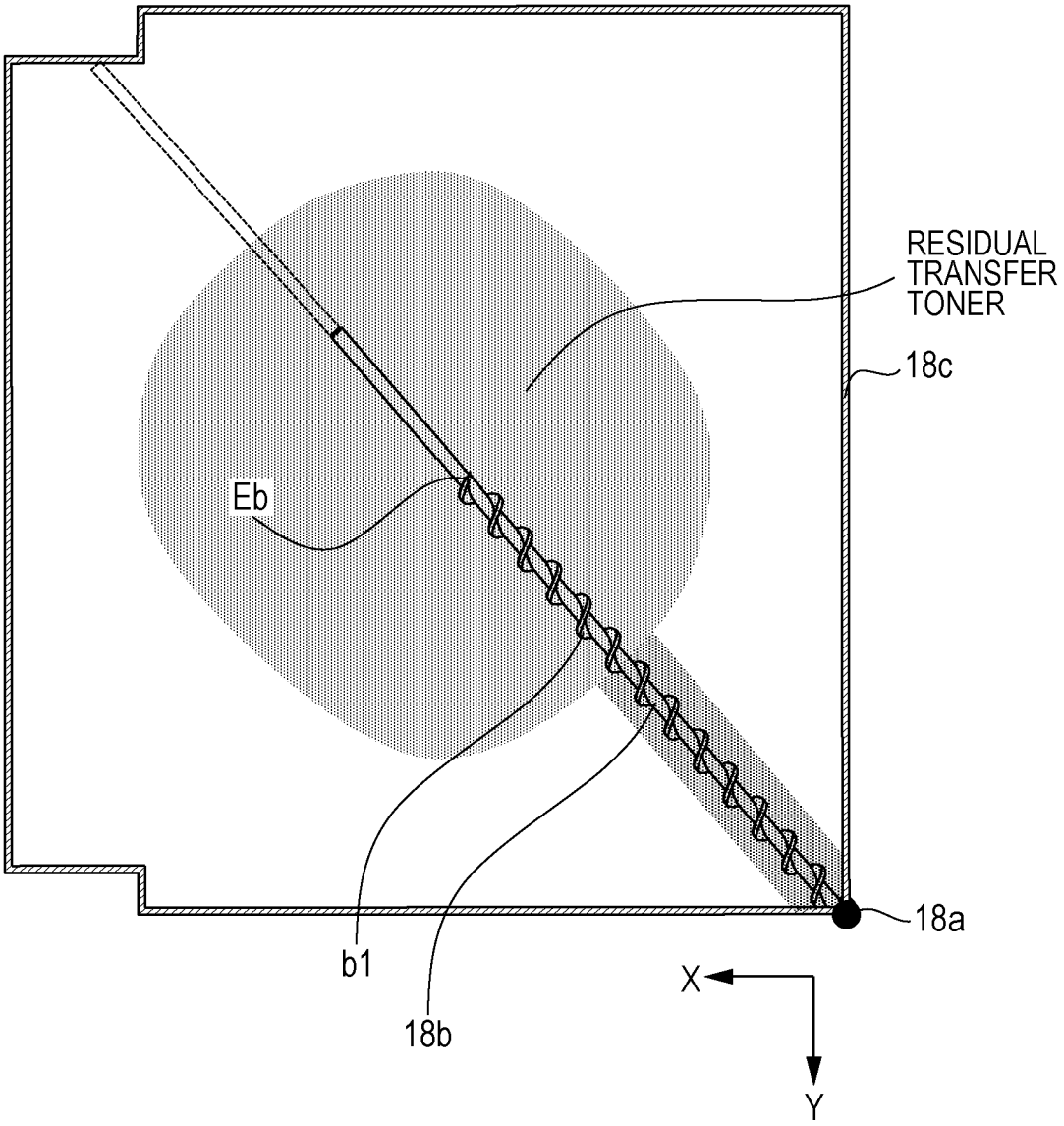
Figure 6D:
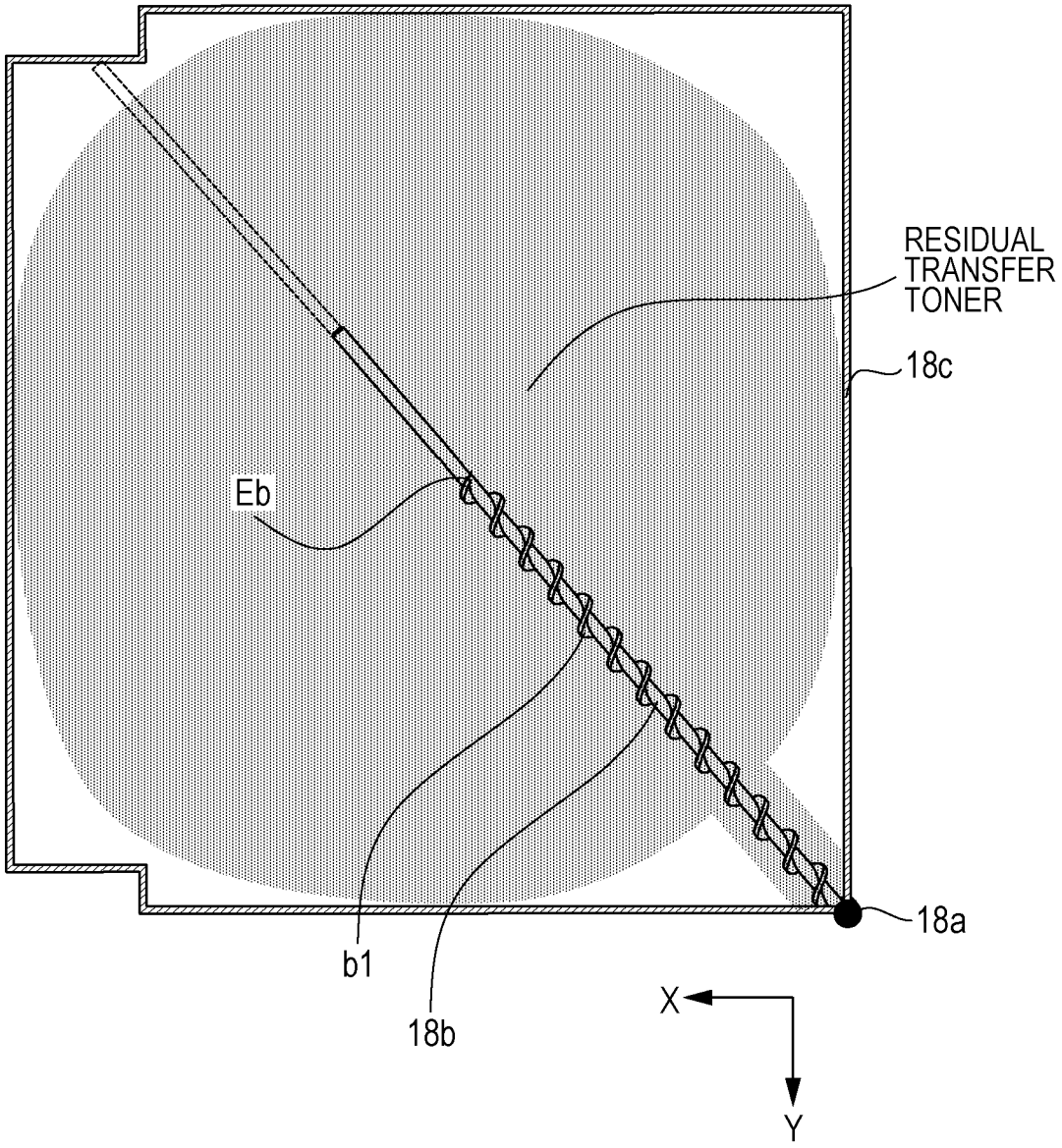

Filling of the residual transfer toner in the container 18 according to the present embodiment will now be described with reference to FIG. 6A to FIG. 6D. FIG. 6A schematically illustrates the container 18 in a projected view on the XY plane before the residual transfer toner reaches the inlet 18*a* of the container 18. FIG. 6B, FIG. 6C, and FIG. 6D schematically illustrate the residual transfer toner that is conveyed from the inlet 18*a* toward the end portion Eb by using the rotating conveyance member 18*b* and that is filled in the container 18.

According to the present embodiment, the residual transfer toner starts to be filled in a state where no residual transfer toner is stored in the container 18 as illustrated in FIG. 6A. When the residual transfer toner reaches the inlet 18*a*, the residual transfer toner is conveyed toward the end portion Eb by using the rotating conveyance member 18*b* as with a state illustrated in FIG. 6B. As illustrated in FIG. 6B, the residual transfer toner that is conveyed toward the end portion Eb in the central region Rc of the container 18 by using the rotating conveyance member 18*b* is accumulated with the end portion Eb centered and filled in the container 18 while concentrically spreading.

One-dot chain lines in FIG. 6A and FIG. 6B trisect the container 18 in the X-axis direction that coincides with the movement direction of the intermediate transfer belt 12 and in the Y-axis direction that coincides with the width direction of the intermediate transfer belt 12. In this way, as illustrated in FIG. 6A and FIG. 6B, the container 18 can be substantially equally divided into nine regions on the XY plane. According to the present embodiment, the end portion Eb of the conveyance member 18*b* is located in the central region Rc of the nine divided regions. The central region Rc corresponds to a region in which a middle region of trisected regions of the container 18 in the X-axis direction overlaps a middle region of trisected regions of the container 18 in the Y-axis direction. The position of the end portion Eb will be described in detail later.

As illustrated in FIG. 6C, the residual transfer toner is continuously conveyed toward the end portion Eb by using the rotating conveyance member 18*b*, continues to spread concentrically, and is filled. After the state in FIG. 6C, the residual transfer toner is further filled, and, as illustrated in FIG. 6D, the residual transfer toner that concentrically spreads reaches four wall surfaces of the upper member 18*c* having a substantially rectangular shape, and the container 18 is filled with the residual transfer toner. According to the present embodiment, the bottom surface of the container 18 is substantially parallel to the bottom surface of the image-forming apparatus 1. In other words, the lower member 18*d* is substantially parallel to the installation surface of the image-forming apparatus 1. With this structure, the residual transfer toner that concentrically diffuses in the container 18 almost simultaneously reaches the four wall surfaces of the container 18, which is preferable for filling efficiency.

Figure 7:
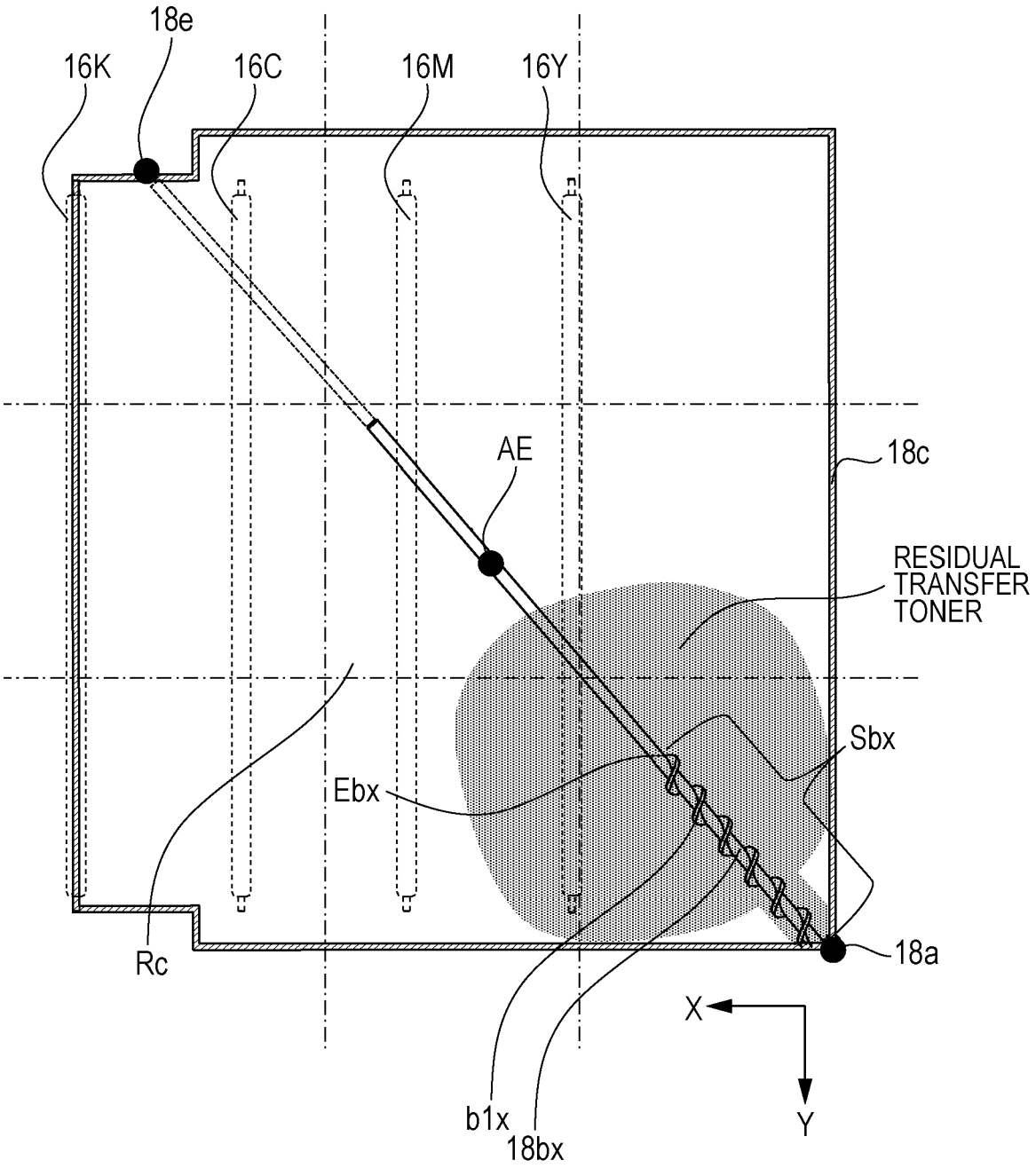
FIG. 7 schematically illustrates a structure in a comparative example against the first example embodiment.

FIG. 7 illustrates a structure in a comparative example against the present embodiment, in which an end portion Ebx of a region Sbx of a conveyance member 18*bx* is nearer than the position of the end portion Eb according to the present embodiment to the inlet 18*a* in the rotation axis direction. In other words, in the comparative example, the end portion Ebx is not located in the central region Rc. In the structure in the comparative example, the end portion Ebx is located upstream of the primary transfer roller 16Y in the X-axis direction that coincides with the movement direction of the intermediate transfer belt 12 and nearer than the primary transfer roller 16K to the drive roller 13, although this is not illustrated. In the following description, components in the comparative example that are substantially the same as those according to the present embodiment are designated by reference characters like to those according to the present embodiment.

The conveyance member 18*bx* includes a conveyance portion blx spirally extending in the rotation axis direction and rotates to convey the residual transfer toner that reaches the inlet 18*a* in the direction of an arrow Sc (FIG. 3A). In the structure in the comparative example, as illustrated in FIG. 7, the residual transfer toner concentrically diffuses in the container 18 with an end of the region Sbx centered, that is, with the end portion Ebx of the conveyance member 18*bx* centered as in the present embodiment. In the structure in the comparative example, however, the end portion Ebx is located upstream of the primary transfer roller 16Y, that is, nearer than a substantially central portion of the container 18 to the inlet 18*a*, and the diffusing residual transfer toner first reaches two wall surfaces of the upper member 18*c* near the inlet 18*a*. In the case where the residual transfer toner is continuously conveyed after a state in FTG. 7, it is difficult for the residual transfer toner to further spread concentrically because the residual transfer toner that is concentric has been partly reached the wall surfaces, and there is a possibility that the torque of the conveyance member 18*bx* increases, or the container 18 deforms.

With the structure in the comparative example, the residual transfer toner can thus concentrically diffuse by using the single conveyance member 18*bx*. However, even when the residual transfer toner is continuously conveyed by using the rotating conveyance member 18*bx* after the state in FIG. 7, the residual transfer toner does not further diffuse concentrically. Accordingly, the filling efficiency of the residual transfer toner in the comparative example is lower than that according to the present embodiment. In the case where the end portion Eb is located outside the central region Rc in a region opposite the inlet 18*a* in the rotation axis direction of the conveyance member 18*bx*, the filling efficiency decreases for the same reason. For this reason, according to the present embodiment, the end portion Eb is located in the central region Rc of the container 18 to efficiently fill the residual transfer toner in the container 18.

In the positional relationship between the transfer unit 11 and the container 18 according to the present embodiment, as illustrated in FIG. 5 and FIG. 6A, the central region Rc of the container 18 is located downstream of the primary transfer roller 16Y and upstream of the primary transfer roller 16C in the movement direction of the intermediate transfer belt 12. Locating the end portion Eb in the central region Rc enables the ratio of the filled residual transfer toner to be increased as described above. Locating the end portion Eb near the center of the central region Rc as much as possible enables the ratio of the filled residual transfer toner to be further increased. That is, regarding the arrangement of the primary transfer rollers 16 of the image-forming apparatus 1 according to the present embodiment, the end portion Eb is located in the central region Rc between the primary transfer roller 16Y and the primary transfer roller 16M in the movement direction of the intermediate transfer belt 12, and this enables the filling efficiency to be further improved.

According to the present embodiment, the central region Rc of the container 18 that is disposed in the region that is defined by the inner circumferential surface of the intermediate transfer belt 12 of the transfer unit 11 is located between the primary transfer rollers 16Y and 16M. The arrangement of the primary transfer rollers 16 in the movement direction (X-axis direction) of the intermediate transfer belt 12 is appropriately determined depending on the positions of the photosensitive drums 40. The arrangement of the photosensitive drums 40 in the X-axis direction is appropriately determined based on the arrangement of the components of the image-forming apparatus 1. That is, in some cases, the positions of the primary transfer rollers 16 in the X-axis direction differ from positions illustrated in the figures according to the present embodiment.

In this case, as illustrated in FIG. 7, the central region Rc is located near an intermediate point AE of a straight line (the imaginary line extending in the rotation axis direction of the conveyance member 18*bx*) that connects the inlet 18*a* and the wall surface 18*e* to each other, and such a case is seen more frequently than the case where the central region Rc is located near the inlet 18*a*. Accordingly, locating the end portion Eb near the intermediate point AE enables the same effects as those according to the present embodiment to be achieved. Similarly, regarding the region opposite the inlet 18*a* in the rotation axis direction of the conveyance member 18*bx*, locating the end portion Eb nearer than the wall surface 18*e* to the intermediate point AE enables the same effects as those according to the present embodiment to be achieved.

According to the present embodiment, the single conveyance member 18*b* is disposed in the container 18, and the residual transfer toner that is conveyed by the conveyance member 18*b* is concentrically filled in the container 18 as describe above. With this structure, the residual transfer toner can be efficiently filled even when there is only the single conveyance member 18*b*. Accordingly, it is not necessary to dispose multiple conveyance members in the container 18, and the ratio of the filled toner to the volume of the container 18 can be increased. In addition, since it is not necessary to dispose multiple conveyance members, the costs of the image-forming apparatus 1 can be decreased.

An existing structure in which multiple conveyance members are disposed in a container needs a connection for rotation of the multiple conveyance members in an internal space of the container that stores the residual transfer toner. In this case, it is necessary to provide a measure for dealing with malfunction that occurs due to a strange noise or vibration when the residual transfer toner adheres to the connection for rotation, and damage to a component due to the toner molten by frictional heat at the connection for rotation. According to the present embodiment, however, it is not necessary to provide a drive connection between the components in the container, and it is not necessary to consider the above matter. Consequently, the residual transfer toner can be stably filled in the container 18 with a simpler structure than an existing one.

In the case where the container 18 is disposed in the transfer unit 11 as in the present embodiment, when the transfer unit 11 is replaced because of the life thereof, the container 18 can be replaced together by replacement operation of the transfer unit 11. Consequently, time that a user or a service member needs for replacement decreases, and usability can be improved. According to the present embodiment, since the container 18 is disposed in the transfer unit 11, a space in which an existing container is disposed is eliminated, and the size of the image-forming apparatus 1 can be decreased.

According to the present embodiment, each primary transfer roller 16 is a low-cost metal roller but is not limited thereto. A conductive brush member, a conductive sheet member, or a roller member having a conductive elastic layer can be used as a transfer member. In the case of using the transfer member such as a roller having a conductive elastic layer, the transfer member may be shifted with respect to the corresponding primary transfer portion as in the present embodiment or may be disposed right below the primary transfer member.

First Example Modification

Figure 8:
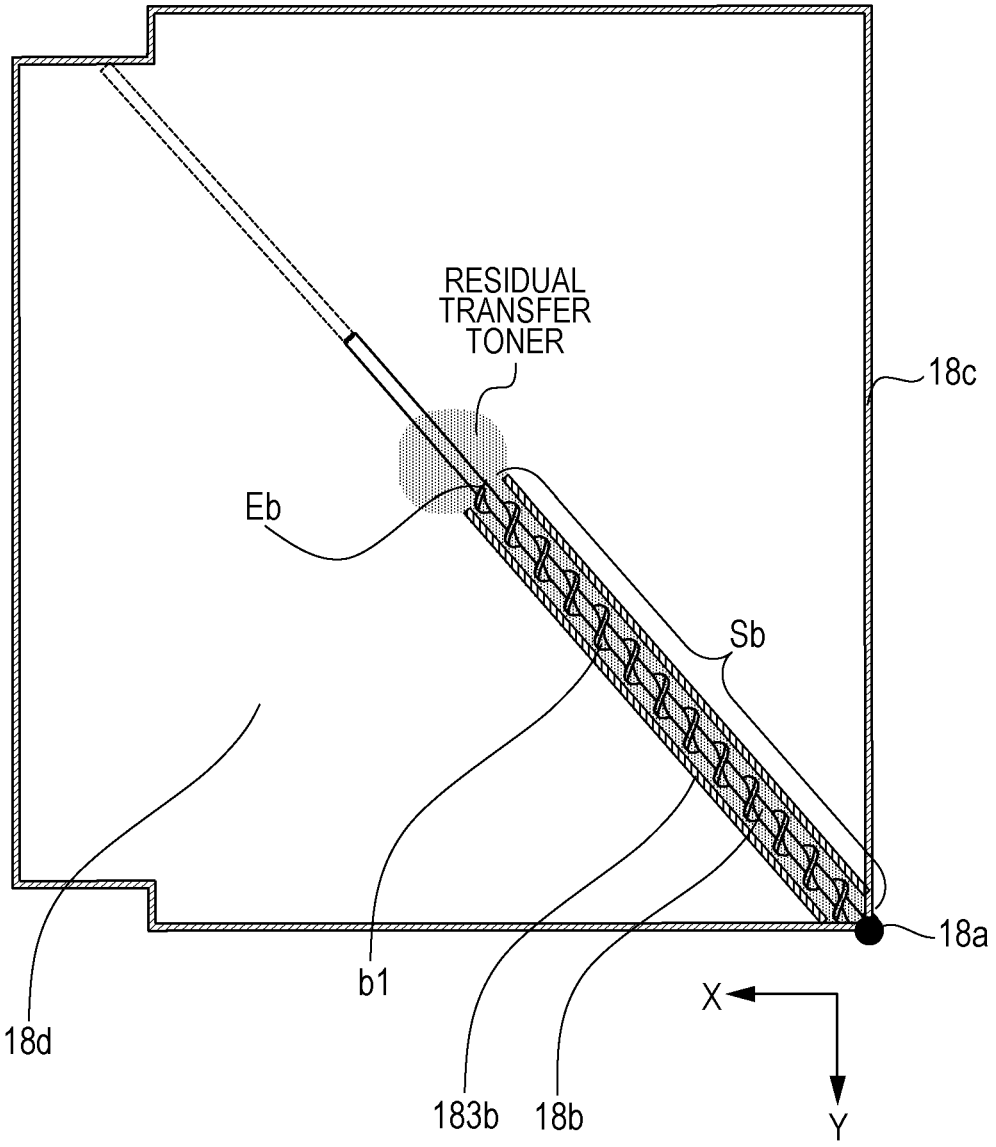
FIG. 8 schematically illustrates a structure according to a first example modification.

FIG. 8 schematically illustrates a first modification to the present embodiment in which the lower member 18*d* includes a conveyance guide 183*b* (guide portion) that covers the conveyance member 18*b* from both sides in the container 18. FIG. 8 schematically illustrates the container 18 in a projected view on the XY plane as in FIG. 6A and FIG. 6B. In the following description, components according to the first modification that are substantially common to those according to the first embodiment are designated by reference characters like to those according to the first embodiment, and a description thereof is omitted.

According to the first modification, as illustrated in FIG. 8, the conveyance guide 183*b* enables the residual transfer toner to be conveyed from the inlet 18*a* toward the central region Rc of the container 18 while preventing the residual transfer toner from leaking from the outside of the conveyance guide 183*b*. Consequently, a toner conveyance loss until the residual transfer toner reaches the substantially central portion of the container 18 decreases, and the residual transfer toner can be more efficiently filled. Here, the inside of the conveyance guide 183*b* means surfaces of the conveyance guide 183*b* that face the conveyance member 18*b*, and the outside of the conveyance guide 183*b* means surfaces opposite the inside.

The shape of the conveyance guide 183*b* is not limited to the shape illustrated in FIG. 8. For example, the shape may be a tunnel shape that covers the upper surface of the conveyance member 18*b* in the Z-axis direction, provided that the residual transfer toner does not leak from the outside of the conveyance guide 183*b*. According to the present modification, to minimize the amount of the residual transfer toner that leaks from the outside of the conveyance guide 183*b*, the conveyance guide 183*b* extends from the inlet 18*a* to the end portion Eb over the entire region Sb in the rotation axis direction of the conveyance member 18*b* but is not limited thereto. The conveyance guide 183*h* may be disposed in a part of the region Sb near the inlet 18*a*. The conveyance guide 183*b* may not continuously extend in the rotation axis direction but may be divided into pieces in separated regions.

Second Example Modification

Figure 9:
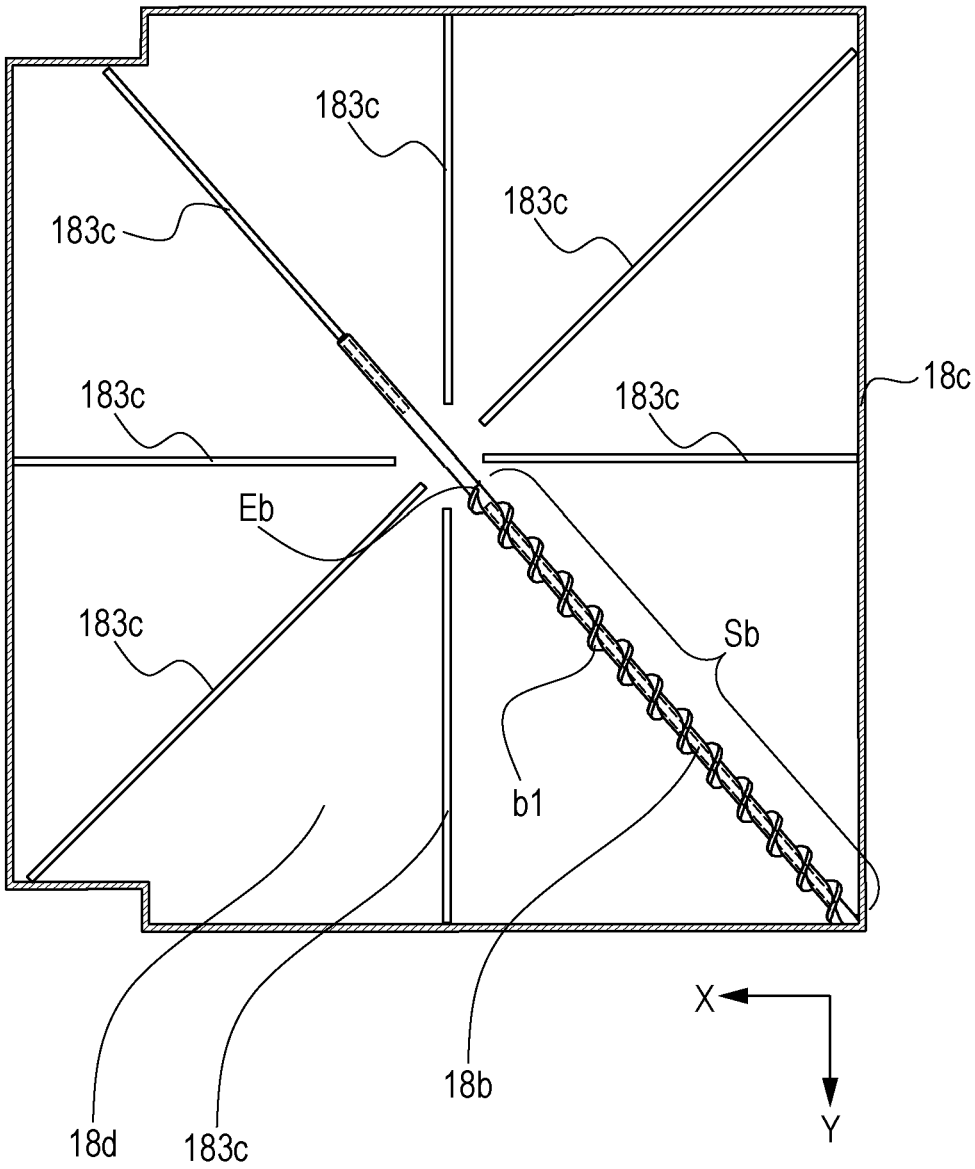
FIG. 9 schematically illustrates a structure according to a second example modification.

FIG. 9 schematically illustrates a second modification to the present embodiment in which the lower member 18*d* of the container 18 includes radial ribs 183*c*. FIG. 9 schematically illustrates the container 18 in a projected view on the XY plane as in FIG. 6A and FIG. 6B. In the following description, components according to the second modification that are substantially common to those according to the first embodiment are designated by reference characters like to those according to the first embodiment, and a description thereof is omitted.

According to the second modification, as illustrated in FIG. 9, the lower member 18*d* includes the ribs 183*c* radially extending from the vicinity of the end portion Eb in the central region Re of the container 18. The ribs 183*c* increase the strength of the container 18 and inhibit the lower member 18*d* from deforming due to an increase in weight when the residual transfer toner is filled. For the container 18 that is disposed in the transfer unit 11, this enables the container 18 to be inhibited from deforming in the Z-axis direction when the residual transfer toner is filled, and a part of the lower member 18*d* can be inhibited from coming into contact with the intermediate transfer belt 12.

According to the present modification, the residual transfer toner that is concentrically filled spreads in directions including the longitudinal directions of the radial ribs 183*c*, and the radial ribs 183*c* do not prevent the residual transfer toner from being filled. The radial ribs 183*c* serve as guides when the residual transfer toner concentrically spreads, enable the residual transfer toner to uniformly spread in each direction, and improve efficiency with which the residual transfer toner is filled in the container 18. The length, height, and number of the ribs 183*c* are not limited to those illustrated in FIG. 9 according to the present modification but may be appropriately determined. From perspective of an increase in the strength of the lower member 18*d*, the ribs 183*c* preferably extend up to the corresponding wall surfaces of the container 18.

Third Example Modification

Figure 10A:
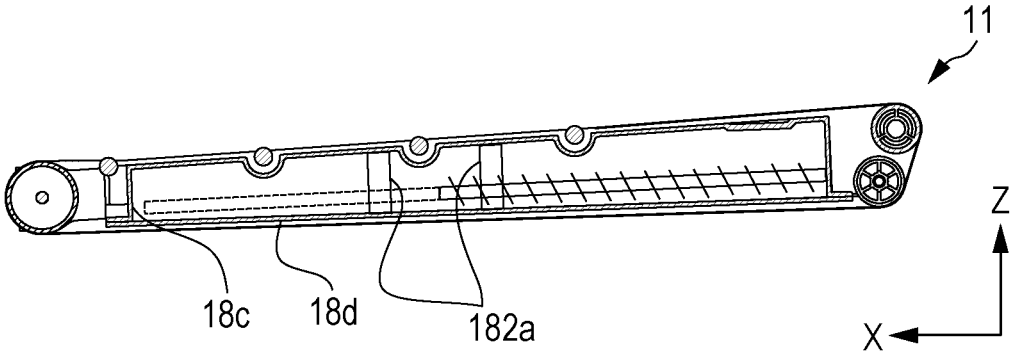
FIG. 10A and FIG. 10B schematically illustrate a structure according to a third example modification.
Figure 10B:
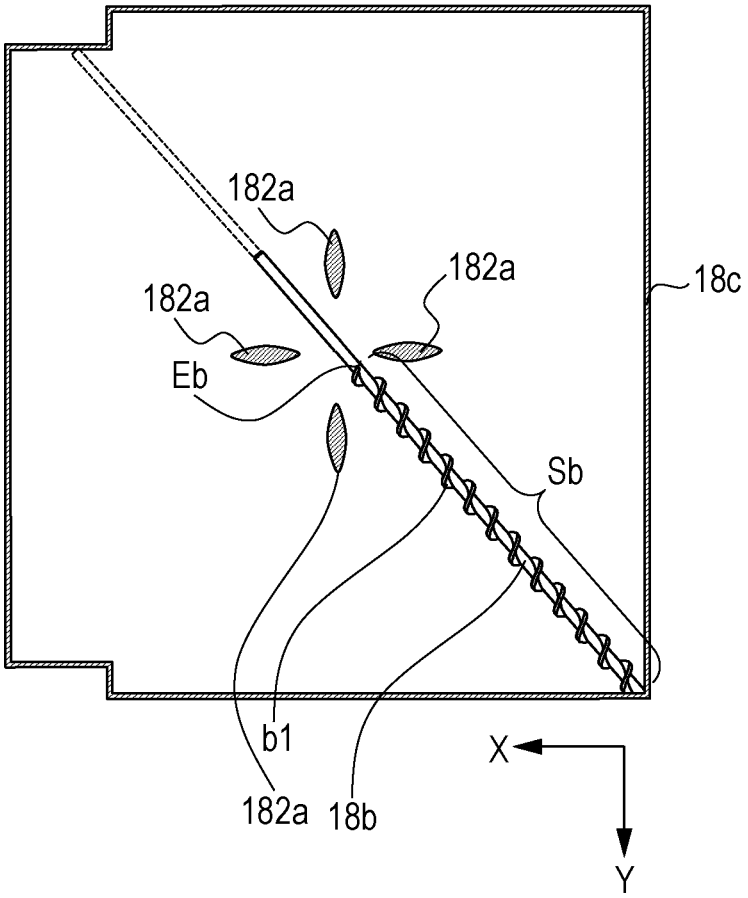

FIG. 10A schematically illustrates a third modification to the present embodiment in which columnar members 182*a* are disposed between the lower member 18*d* and the upper member 18*c* in the container 18. FIG. 10B schematically illustrates the container 18 in a projected view on the XY plane as in FIG. 6A to FIG. 6D. In the following description, components according to the third modification that are substantially common to those according to the first embodiment are designated by reference characters like to those according to the first embodiment, and a description thereof is omitted.

According to the present modification, as illustrated in FIG. 10A, the columnar members 182*a* are disposed near the central region Rc. More specifically, the columnar members 182*a* are disposed near a substantially central portion of the upper member 18*c* and connect the upper member 18*c* and the lower member 18*d* to each other. With this structure, the container 18 is inhibited from deforming in the Z-axis direction when the residual transfer toner is filled, and the upper member 18*c* and the lower member 18*d* can be inhibited from coming into contact with the intermediate transfer belt 12.

According to the present modification, as illustrated in FIG. 10B, the columnar members 182*a* are located near the end portion Eb but are spaced from the end portion Eb. Consequently, the columnar members 182*a* do not prevent the residual transfer toner from being filled, can support a region in the container 18 in which the residual transfer toner starts to be accumulated, and can efficiently inhibit the lower member 18*d* from deforming. Each columnar member 182*a* preferably has a shape that does not prevent the residual transfer toner that concentrically diffuses from spreading. As illustrated in FIG. 10B, an example of such a shape is such that a section of each columnar member 182*a* has a streamline shape extending in a direction that substantially coincides with a direction in which the residual transfer toner radially spreads.

According to the present modification, as illustrated in FIG. 10B, the four columnar members 182*a* are disposed near the end portion Eb. However, the number of the columnar members 182*a* is not limited thereto. According to the present modification, the columnar members 182*a* and the lower member 18*d* are secured to each other with screws but are not limited thereto. The columnar members 182*a* that are included in the upper member 18*c* may be secured to the lower member 18*d* by a welding method such as thermal welding or ultrasonic welding, or a joining method with an adhesive. According to the present modification, the upper member 18*c* includes the columnar members 182*a* but is not limited thereto. The lower member 18*d* may include the columnar members 182*a*, and the columnar members 182*a* may be secured to the upper member 18*c* by the above securing method.

Second Example Embodiment

In an example described according to the first embodiment, the container 18 that stores the residual transfer toner is disposed in the transfer unit 11, more specifically, in the region that is defined by the inner circumferential surface of the intermediate transfer belt 12. A second embodiment, however, differs from the first embodiment in that a container 118 that stores the residual transfer toner is not disposed inside the inner circumferential surface of the intermediate transfer belt 12 but is disposed outside the transfer unit 11. According to the second embodiment, the other structure of the image-forming apparatus 1 except for the position of the container 118 is substantially the same as that according to the first embodiment. Accordingly, components common to those according to the first embodiment are designated by reference characters like to those according to the first embodiment, and a description there of is omitted.

Figure 11:
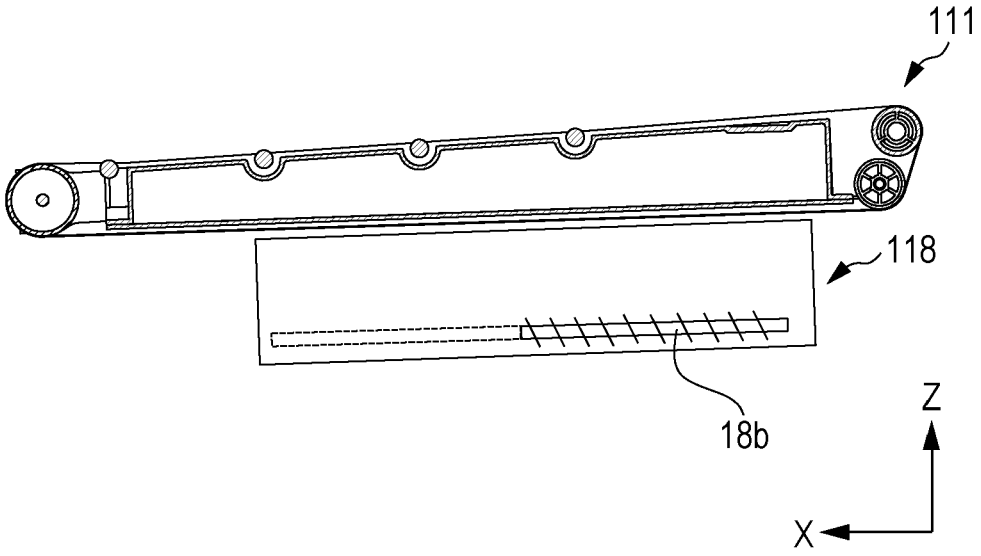
FIG. 11 schematically illustrates a structure according to a second example embodiment.

FIG. 11 schematically illustrates the position of the container 118 according to the present embodiment. As illustrated in FIG. 11, the container 118 is disposed below the bottom surface of a transfer unit 111 in the Z-axis direction. Disposing the container 118 outside the transfer unit 111 enables only the container 118 to be detached from the image-forming apparatus 1 while the ability to fill the residual transfer toner as described according to the first embodiment is maintained. That is, according to the present embodiment, the container 118 can be replaced regardless of the life of the transfer unit 111.

According to the above embodiments, the image-forming apparatus 1 uses an intermediate transfer method with the intermediate transfer belt 12 but is not limited thereto. The use of the structure for collecting the residual transfer toner described according to the embodiments enables an image-forming apparatus 1 that includes a conveyance belt that conveys a transfer material P and that uses a direct transfer method to achieve the same effects as those according to the embodiments.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to example embodiments, it is to be understood that the disclosure is not limited to the disclosed example embodiments. The scope of the following Claims is to be accorded the broadest interpretation so as to encompass all such modifications and equivalent structures and functions.

This application claims the benefit of Japanese Patent Application No. 2019-102858, filed May 31, 2019, and Japanese Patent Application No. 2020-076005, filed Apr. 22, 2020, which are hereby incorporated by reference herein in their entirety.

What is claimed is:

1. A transfer unit disposed in an image-forming apparatus, wherein the image-forming apparatus includes an image-bearing member configured to bear a toner image, the transfer unit comprising:

a belt that is movable, endless, and in contact with the image-bearing member;

a collection member which is in contact with the belt and configured to collect toner remaining on the belt;

a container, which is disposed in a region defined by an inner circumferential surface of the belt, which has an inlet through which the toner collected by the collection member enters the container, and which has a bottom surface on which the toner entering through the inlet is to be supported and an upper surface that is opposite to the bottom surface of the container; and a single conveyance member which includes a conveyance portion spirally extending in a rotation axis direction and which is configured to rotate to convey the toner from the inlet in the container, wherein, in a projected view of the container on a horizontal plane in a direction orthogonal to a movement direction and a width direction, a central region of the container is located in a region in which a middle region of trisected regions of the container in the movement direction overlaps a middle region of trisected regions of the container in the width direction, and wherein the single conveyance member conveys the toner from the inlet toward the central region of the container.

2. The transfer unit according to claim 1, further comprising:

a driving rotary member configured to stretch the belt and to rotate to move the belt when a driving force from a drive source is applied to the driving rotary member; and a drive connection member configured to transmit a rotational force of the driving rotary member, wherein the single conveyance member rotates with rotation of the driving rotary member by engagement of a gear which is disposed at an end portion of the single conveyance member on a side of the inlet and the drive connection member.

3. The transfer unit according to claim 2, further comprising a plurality of transfer members including a first transfer member and a second transfer member, wherein the first transfer member is located at a most upstream position in the movement direction among the plurality of transfer members, and the inlet is located between the first transfer member and the driving rotary member.

4. The transfer unit according to claim 3, wherein the inlet is nearer than the first transfer member to the driving rotary member in the movement direction.

5. The transfer unit according to claim 3, wherein the second transfer member is located at a most downstream position in the movement direction among the plurality of transfer members.

6. The transfer unit according to claim 3, wherein the second transfer member is located upstream of a transfer member which is located at a most downstream position in the movement direction among the plurality of transfer members.

7. The transfer unit according to claim 3, further comprising:

a first urging member configured to urge the first transfer member toward the belt; and a second urging member configured to urge the second transfer member toward the belt, wherein there is no unit for separating the first transfer member and the second transfer member from the belt against an urging force of the first urging member and an urging force of the second urging member.

8. The transfer unit according to claim 7, wherein the container has grooved portions, which face the first transfer member and the second transfer member, which extend along an extension direction in which the first transfer member and the second transfer member extend, and which are recessed in a direction away from the first transfer member and the second transfer member.

9. The transfer unit according to claim 1, wherein an end portion of the single conveyance member opposite to the inlet in the rotation axis direction is supported by a support portion which is disposed on the bottom surface of the container.

10. The transfer unit according to claim 9, wherein the single conveyance member has a region in which the conveyance portion is not disposed, between an end portion of the conveyance portion and the support portion in the rotation axis direction.

11. The transfer unit according to claim 1, wherein the container is disposed so as to be substantially parallel to a bottom surface of an apparatus body of the image-forming apparatus.

12. The transfer unit according to claim 1, further comprising a plurality of transfer members including a first transfer member and a second transfer member, wherein the container includes a frame body formed by an upper member, which is disposed on a side of the first transfer member and the second transfer member and which has the upper surface, and a lower member which is disposed on a side of a bottom surface of an apparatus body of the image-forming apparatus and which has the bottom surface of the lower member, and wherein the single conveyance member is disposed in an inside of the frame body of the container formed by bonding the upper member and the lower member.

13. The transfer unit according to claim 12, wherein, in an inside of the container, the lower member includes guide portions configured to guide both sides of a position in which the single conveyance member is provided.

14. The transfer unit according to claim 12, wherein, in an inside of the container, the lower member includes ribs radially extending from a vicinity of an end portion of the conveyance portion.

15. The transfer unit according to claim 12, wherein, in an inside of the container, a columnar member which connects the upper member and the lower member to each other is disposed in a vicinity of an end portion of the conveyance portion.

16. An image-forming apparatus comprising:

an image-bearing member configured to bear a toner image:

a belt that is movable, endless, and in contact with the image-bearing member;

a transfer member configured to transfer the toner image from the image-bearing member to the belt;

a collection member which is in contact with the belt and configured to collect toner remaining on the belt;

a container, which is disposed in a region defined by an inner circumferential surface of the belt, which has an inlet through which the toner collected by the collection member enters the container, and which has a bottom surface on which the toner entering through the inlet is to be supported and an upper surface that is opposite to the bottom surface of the container; and a single conveyance member which includes a conveyance portion spirally extending in a rotation axis direction and which is configured to rotate to convey the toner from the inlet in the container, wherein, in a projected view of the container on a horizontal plane in a direction orthogonal to a movement direction and a width direction, a central region of the container is located in a region in which a middle region of trisected regions of the container in the movement direction overlaps a middle region of trisected regions of the container in the width direction, and wherein the single conveyance member conveys the toner from the inlet toward the central region of the container.

17. The image-forming apparatus according to claim 16, wherein the belt is an intermediate transfer belt, and the toner image, transferred from the image-bearing member to the intermediate transfer belt, is transferred from the intermediate transfer belt to a transfer material at a transfer portion at which the intermediate transfer belt comes into contact with the transfer material.

18. The image-forming apparatus according to claim 16, wherein the belt is a conveyance belt configured to bear and convey a transfer material, and the toner image borne by the image-bearing member is transferred to the transfer material which is conveyed by the conveyance belt.

19. A transfer unit disposed in an image-forming apparatus, wherein the image-forming apparatus includes a first image-bearing member configured to bear a toner image and a second image-bearing member which is disposed at a position that is different from a position of the first image-bearing member and which is configured to bear a toner image, the transfer unit comprising:

a belt that is movable, endless, and in contact with the first image-bearing member and the second image-bearing member;

a first transfer member, which is in contact with an inner circumferential surface of the belt, which extends in an extension direction orthogonal to a movement direction of the belt, and which is configured to transfer the toner image from the first image-bearing member to the belt;

a second transfer member, which is in contact with the inner circumferential surface of the belt, which extends in the extension direction, and which is configured to transfer the toner image from the second image-bearing member to the belt;

a collection member which is in contact with the belt and which is configured to collect toner remaining on the belt;

a container which has an inlet through which the toner collected by the collection member enters the container; and a single conveyance member which is configured to rotate to convey the toner conveyed from the inlet toward the container in the container, and which includes a conveyance portion spirally extending in a rotation axis direction, wherein the first transfer member is located upstream of the second transfer member and downstream of the collection member in the movement direction of the belt, wherein, in a projected view of the container on a horizontal plane in a direction orthogonal to the movement direction and the extension direction, an end portion of the conveyance portion provided opposite to the inlet in the rotation axis direction is located in a vicinity of an intermediate point of a straight line which connects a position of the inlet and a position in which an imaginary line extending in the rotation axis direction intersects with the container, and wherein the rotation axis direction is not orthogonal to the movement direction and is not orthogonal to the extension direction.

20. The transfer unit according to claim 19, wherein the end portion is located nearer than the position in which the imaginary line intersects with the container to the intermediate point in the rotation axis direction and located nearer than the position of the inlet to the intermediate point in the rotation axis direction.

* * * * *